US005381124A

United States Patent [19]

Roshen

[11] Patent Number: 5,381,124

[45] Date of Patent: Jan. 10, 1995

[54] MULTI-TURN Z-FOLDABLE SECONDARY WINDING FOR A LOW-PROFILE, CONDUCTIVE FILM TRANSFORMER

[75] Inventor: Waseem A. Roshen, Clifton Park, N.Y.

[73] Assignee: General Electric Company, Schenectady, N.Y.

[21] Appl. No.: 174,922

[22] Filed: Dec. 29, 1993

[51] Int. Cl.[6] ..... H01F 27/28

[52] U.S. Cl. ..... 336/200; 336/183

[58] Field of Search ..... 336/83, 183, 178, 200; 361/749; 174/254; 439/67, 77

[56] References Cited

U.S. PATENT DOCUMENTS

| | | | |
|---|---|---|---|
| 2,917,605 | 11/1959 | Wales, Jr. | 336/200 |
| 4,736,035 | 8/1988 | Zeeman | 310/208 |
| 4,959,630 | 9/1990 | Yerman et al. | 336/183 X |
| 5,017,902 | 5/1991 | Yerman et al. | 363/83 |
| 5,084,958 | 2/1992 | Yerman et al. | 363/200 X |
| 5,126,714 | 6/1992 | Johnson | 336/183 X |
| 5,126,715 | 6/1992 | Yerman et al. | 363/183 |
| 5,134,770 | 8/1992 | Yerman et al. | 363/200 X |
| 5,250,915 | 10/1993 | Ikeda et al. | 333/181 |
| 5,276,421 | 1/1994 | Boitard | 336/180 |
| 5,291,173 | 3/1994 | Yerman et al. | 336/183 |

OTHER PUBLICATIONS

"High-Frequency, Low-Profile Inductor," W. A. Roshen et al., Ser. No. 07/838,656 (GE Docket No. RD-20467), filed Feb. 20, 1992.

"Low-Profile, Multi-Pole Transformer with Center-Tapped Secondary," W. A. Roshen et al., Ser. No. 07/838,953 (GE Docket No. RD-21008), filed Feb. 21, 1992.

"Z-Foldable Secondary Winding for a Low-Profile, Multi-Pole Transformer," A. J. Yerman et al., Ser. No. 07/838,958 (GE Docket No. RD-20748), filed Feb. 21, 1992 Allowed-U.S. Pat. No. 5,291,173.

"Conductive Film Magnetic Components," A. J. Yerman et al., U.S. Pat. No. 5,084,958, issued Feb. 4, 1992.

*Primary Examiner*—Leo P. Picard
*Assistant Examiner*—L. Thomas
*Attorney, Agent, or Firm*—Jill M. Breedlove; Marvin Snyder

[57] ABSTRACT

A low-profile, conductive film transformer includes a conductive film primary winding and a multi-turn, conductive film secondary winding. The multi-turn secondary winding is configured on a continuous secondary conductive film which is disposed on at least one surface of a secondary dielectric membrane and has at least two portions arranged as mirror images of each other. Each of the portions has a plurality of sections; and each of the sections includes an even number of apertures, each of the apertures corresponding to a separate respective magnetic pole. There are at least two adjacent poles per section along at least one longitudinal pole axis. The conductive film is z-folded to form a stack of winding layers with a single turn per two adjacent layers about each magnetic pole, each layer comprising one section of the winding. Each single turn about each respective adjacent pole along each longitudinal axis is connected in series to form a total number of secondary winding turns corresponding to the number of sections in each portion of the conductive film winding. The multi-turn secondary winding is interleaved with a conductive film primary winding and disposed in a magnetic core. All of the secondary winding terminations are integral with the winding itself and are aligned, allowing for simple connections therebetween as well as to other circuit components.

17 Claims, 15 Drawing Sheets

MULTI-TURN Z-FOLDABLE SECONDARY WINDING FOR A LOW-PROFILE, CONDUCTIVE FILM TRANSFORMER

FIELD OF THE INVENTION

The present invention relates generally to conductive film magnetic circuit components and, more particularly, to a multi-turn, z-foldable secondary winding for a low-profile, conductive film transformer.

BACKGROUND OF THE INVENTION

Commonly assigned U.S. Pat. No. 5,126,715 of A. J. Yerman and W. A. Roshen, issued Jun. 30, 1992 and incorporated by reference herein, describes a low-profile, multi-pole, conductive film transformer. The transformer of U.S. Pat. No. 5,126,715 includes a continuous, serpentine primary winding that is configured and z-folded to form a multi-pole, multi-layer winding having separate secondary winding layers interleaved therewith. Conductive connecting strips are used to electrically connect the separate secondary winding layers together.

The conductive film transformer of U.S. Pat. No. 5,126,715 is limited to single-turn secondary windings. In addition, the single-turn secondary winding has rather complicated winding terminations, which limits its application and increases the losses. However, it is desirable for many applications to employ a multi-turn secondary winding in order to lower the magnetic flux density in the core and furthermore to reduce the height of the device. To be practicable, such a multi-turn winding configuration should have relatively simple winding terminations and connections and should have relatively low winding losses.

SUMMARY OF THE INVENTION

A low-profile, conductive film transformer comprises a conductive film primary winding and a multi-turn, conductive film secondary winding. The multi-turn secondary winding comprises a continuous secondary conductive film disposed on at least one surface of a secondary dielectric membrane and having at least two portions arranged as mirror images of each other. Each of the two portions comprises a plurality of sections; and each of the sections includes an even number of apertures, each of the apertures corresponding to a separate respective magnetic pole. There are at least two adjacent poles per section along at least one longitudinal pole axis. The conductive film is z-folded to form a stack of winding layers with a single turn per two adjacent layers about each magnetic pole, each layer comprising one section of the winding. Each single turn about each respective adjacent pole along each longitudinal pole axis is connected in series to form a total number of secondary winding turns corresponding to the number of sections in each portion of the conductive film winding. The multi-turn secondary winding further includes an end terminal at each end of the conductive film. The end terminals are connected together. At least one additional terminal is situated where each portion meets. Each corresponding additional terminal is connected together such that each of the portions arranged as mirror images are connected in parallel to each other.

The multi-turn secondary winding is interleaved with a conductive film primary winding and disposed in a magnetic core. Advantageously, all of the secondary winding terminations are aligned on one side of the core, allowing for simple connections therebetween as well as to other circuit components. As an additional advantage, the connections between corresponding secondary winding terminations do not require vias.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1A:
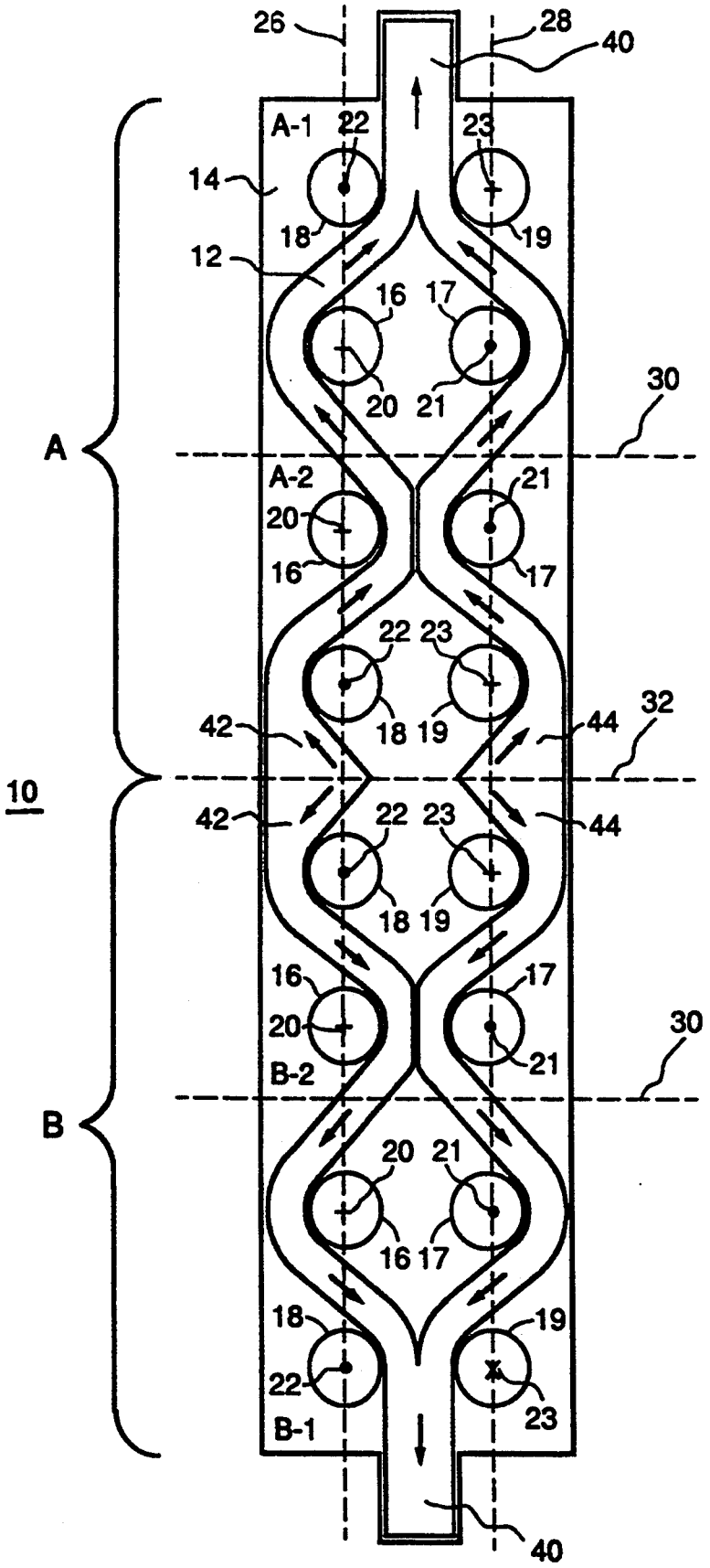
FIG. 1A is a top view of a multi-turn, conductive film secondary winding according to the present invention.

FIG. 1A illustrates a multi-turn, conductive film secondary winding 10 according to the present invention. Secondary winding 10 comprises a secondary conductive film 12 disposed on at least one surface of a secondary dielectric membrane 14. Secondary winding 10 is structured as having at least two portions A and B which are mirror images of each other. Each portion comprises a plurality of sections, shown as two sections A-1 and A-2 and B-1 and B-2, respectively, in FIG. 1; and each of these sections includes an even number of apertures 16–19, each of the apertures corresponding to a separate respective magnetic pole 20–23. There are at least two adjacent poles per section along at least one longitudinal pole axis. By way of example, FIG. 1 illustrates a secondary winding configuration having four magnetic poles 20–23, with two adjacent poles per section along each of two longitudinal axes 26 and 28.

In a preferred embodiment of secondary winding 10, secondary conductive film 12 comprises copper, and dielectric membrane 14 comprises a polyimide film, such as Kapton polyimide film manufactured by E. I. Du Pont de Nemours and Company. However, secondary conductive film 12 may comprise other suitable metals, such as, for example aluminum; and dielectric membrane 14 may comprise other suitable dielectric materials. As another alternative embodiment, a dielectric coating on the secondary conductive film may be used instead of a dielectric membrane.

Figure 1B:
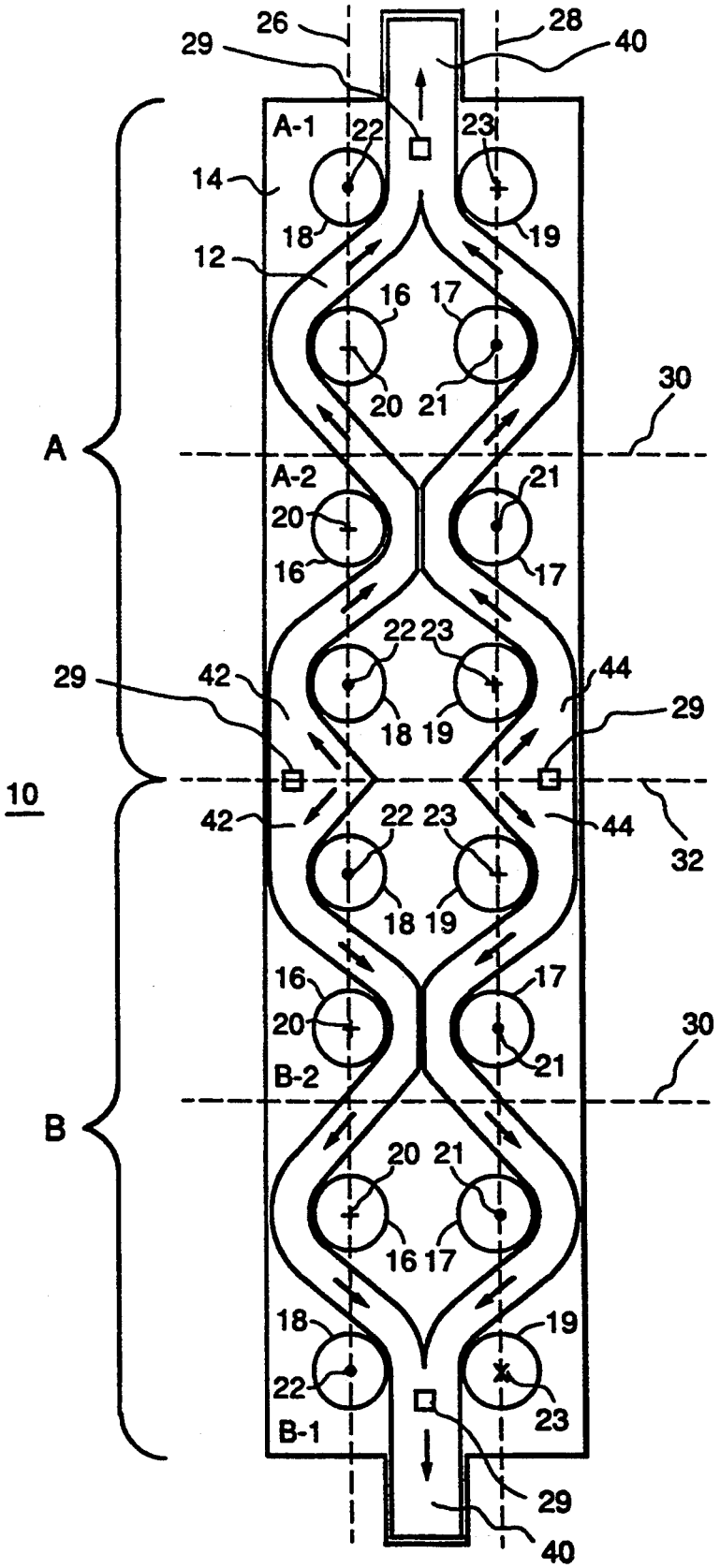
Figure 1B is a top view illustrating an alternative embodiment of the secondary conductive film winding of FIG. 1A.

Although FIG. 1A illustrates secondary conductive film winding 10 as comprising a secondary conductive film disposed on only one side of dielectric membrane 14, a secondary conductive film may alternatively be situated on the other side or both sides of the dielectric membrane. FIG. 1B shows vias 29 for secondary conductive films on both sides of the dielectric membrane together.

Secondary conductive film 10 is z-folded along fold lines 30 and 32; fold lines 30 indicate folding in one direction, and fold lines 32 indicate folding in the opposite direction. (FIG. 5, described hereinbelow, illustrates z-folding.) The result is a stack of winding layers, each layer comprising one section of each portion of the winding, with a single turn per two adjacent layers about each magnetic pole. Each single turn about each respective adjacent pole along each longitudinal pole axis is connected in series to form a total number of secondary winding turns corresponding to the number of sections in each portion A and B of the conductive film winding. Hence, as will be appreciated by those of ordinary skill in the art, each portion A and B may be extended to include additional sections longitudinally, resulting in additional secondary winding turns. As an example, FIG. 2 shows a secondary winding having winding portions A and B, each portion having three sections 1–3 to form a three-turn secondary winding configuration.

Multi-turn secondary winding 10 further includes an end terminal 40 at each end of the conductive film. End terminals 40 are connected together during final transformer assembly, as described hereinbelow. Additional secondary winding terminals 42 and 44 are provided where each portion of the winding meets another portion of the winding, and each corresponding additional terminal is connected together such that each portion of the winding is connected in parallel to the other portion(s).

By way of illustration, +'s are provided to indicate that the direction of magnetic flux within the respective poles extends downward, and dots are provided to indicate that the direction of magnetic flux within the respective poles extends upward. Each arrow indicates the corresponding direction of current flow.

Figure 2:
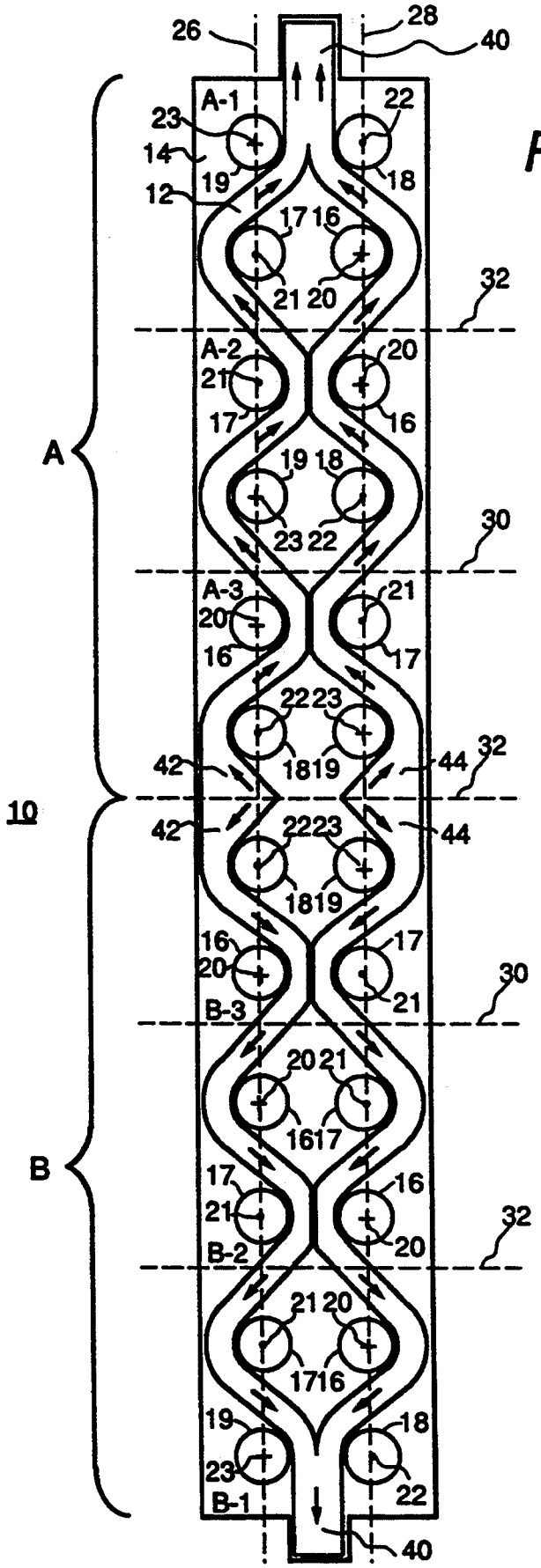
FIG. 2 is a top view of a multi-turn, conductive film secondary winding according to an alternative embodiment of the present invention.
Figure 3:
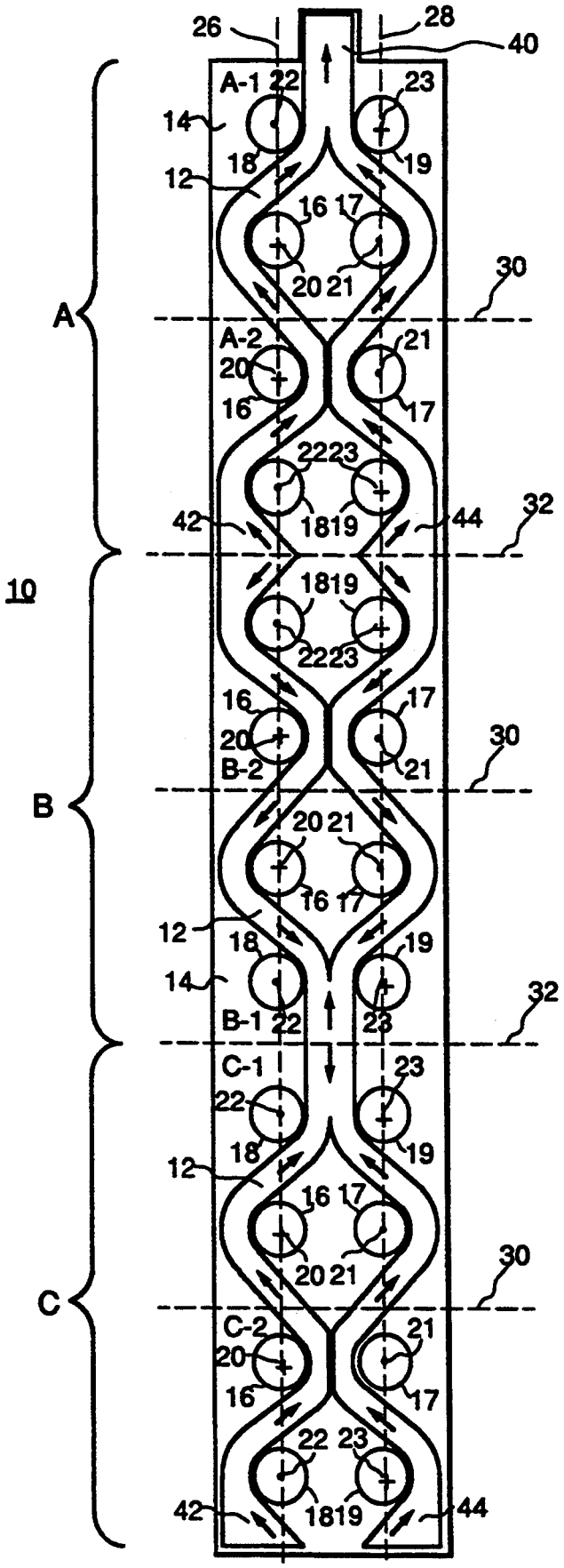
FIG. 3 is a top view of a multi-turn, conductive film secondary winding according to another alternative embodiment of the present invention.

Although only two portions A and B are illustrated in FIGS. 1 and 2, additional winding portions may be added, if desired. For example, FIG. 3 shows a secondary winding 10 having a third portion C which is arranged as a mirror image of adjacent portion B. Corresponding additional terminals 42 and 44 are connected together, forming a parallel connection of the corresponding portions of the winding. Still additional portions may be added and connected in the same parallel fashion as A, B and C, if desired.

Figure 4:
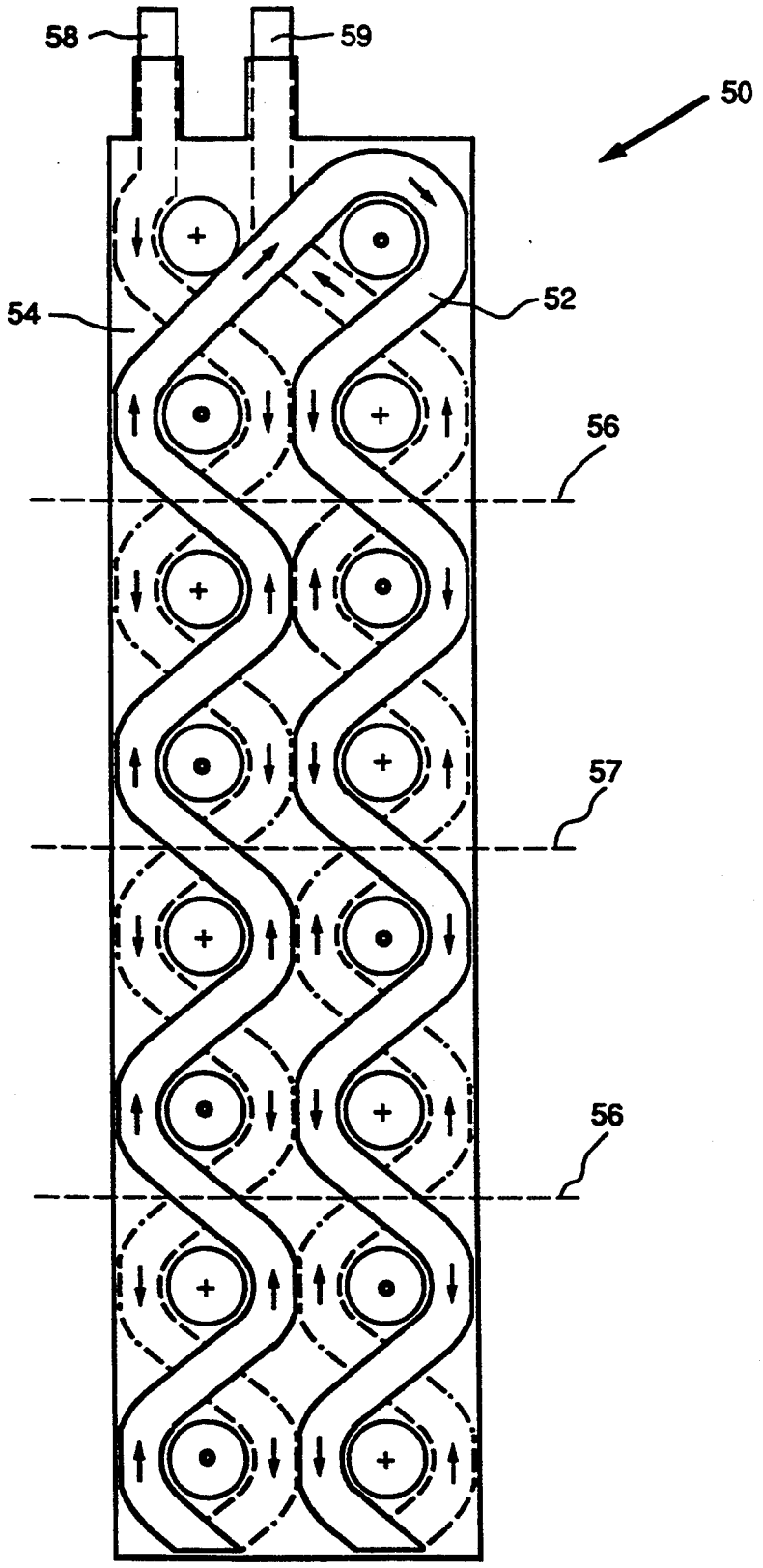
FIG. 4 PRIOR ART
FIG. 4 is a top view of a conductive film primary winding of the prior art which is useful in combination with a multi-turn secondary winding in order to construct a transformer according to the present invention.

FIG. 4 illustrates a suitable primary winding 50 of a type described in U.S. Pat. No. 5,126,715, cited hereinabove, for use in a low-profile transformer winding according to the present invention. Primary winding 50 includes a continuous primary conductive film 52 having a generally serpentine configuration disposed on a dielectric membrane 54. Like the secondary winding, primary conductive film 52 is comprised of a suitable metal such as copper or aluminum; and dielectric membrane 54 is comprised of a suitable dielectric such as Kapton polyimide film. Dotted lines 56 and 57 represent fold lines for z-folding the primary conductive film, as described in U.S. Pat. No. 5,126,715. Specifically, fold lines 56 indicate folding in one direction; and fold lines 57 indicate folding in the opposite direction. Primary winding 50 is thus configured to have at least one winding turn about each of two pairs of magnetic poles. Primary winding 50 includes terminals 58 and 59 shown as being aligned at one end of the winding.

Figure 5:
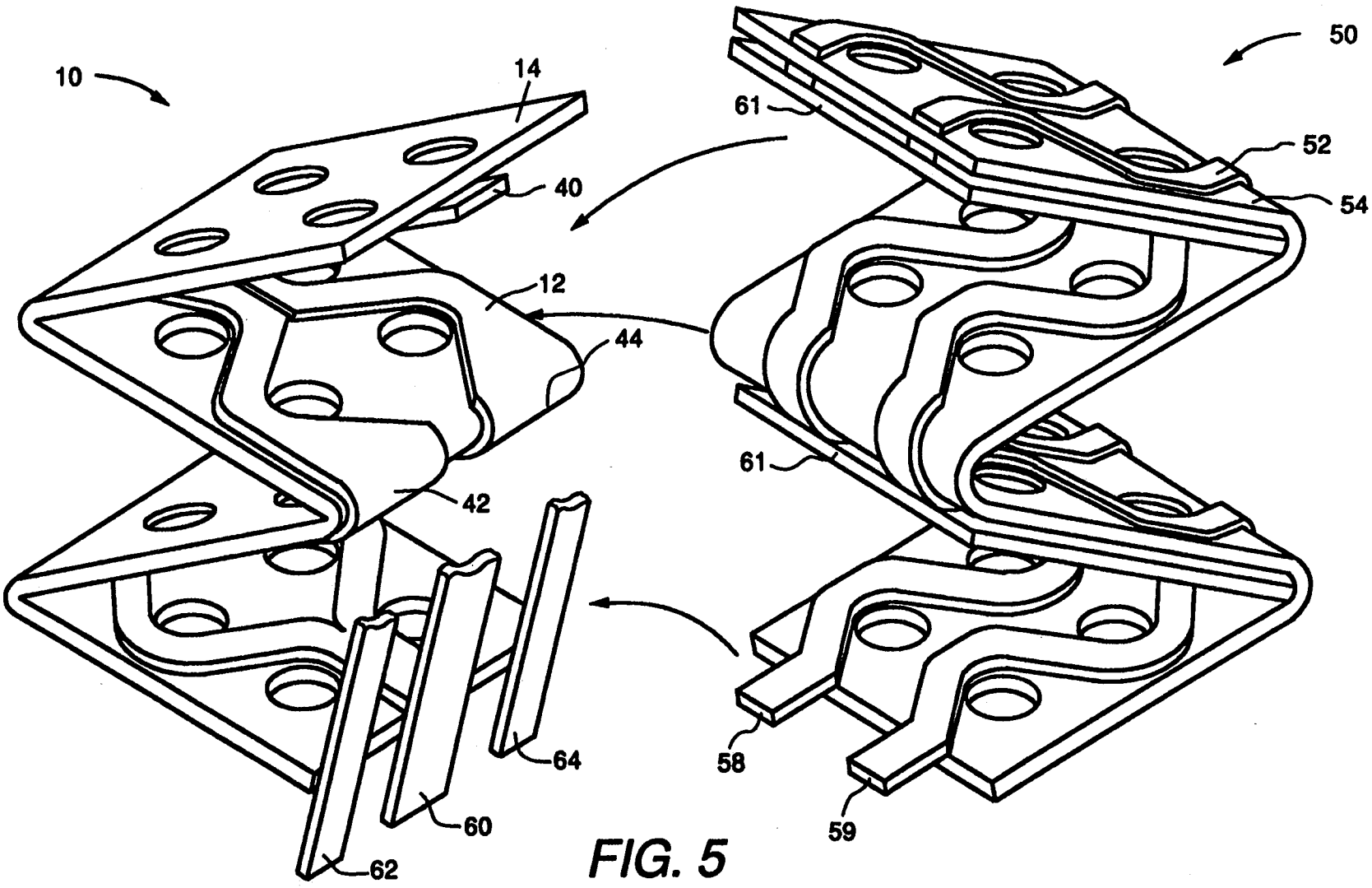
FIG. 5 is a perspective view showing z-folding and interleaving of primary and secondary windings according to the present invention.

As shown in FIG. 5, a multi-turn secondary winding 10 according to the present invention, such as that of FIG. 1, is z-folded and interleaved with a primary winding 50, such as that of FIG. 4, to form a low-profile conductive film transformer. The arrows in FIG. 5 indicate how the layers of the primary and secondary winding are interleaved. Additional dielectric layers 61 are inserted, as appropriate, between primary and secondary winding layers. Metallic strips 60, 62 and 64 are used to connect corresponding winding terminations 40, 42 and 44 together, respectively.

Figure 6:
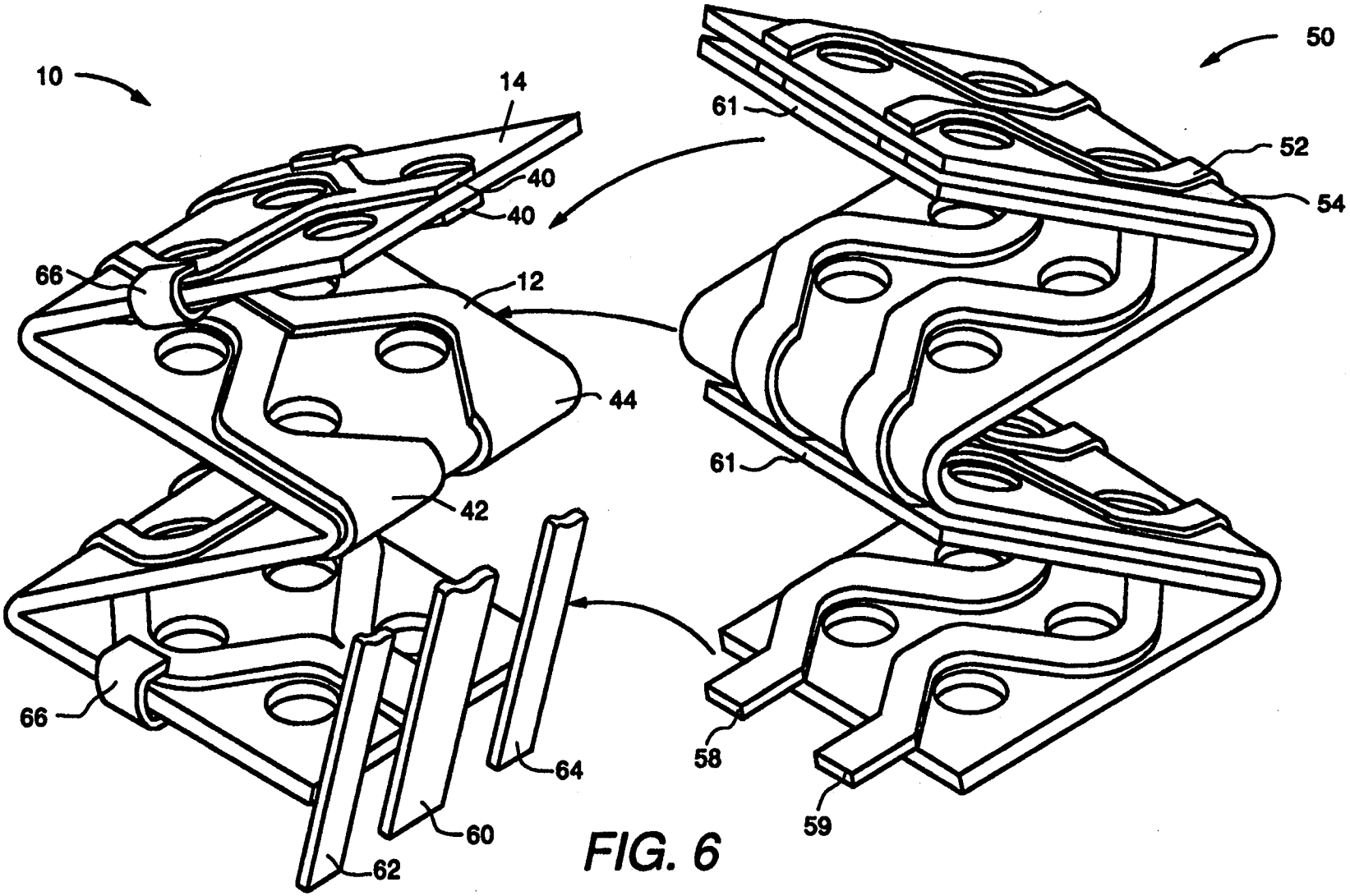
FIG. 6 is an alternative embodiment of FIG. 5 with a double-sided secondary winding.

FIG. 6 illustrates an alternative embodiment of the winding configuration of FIG. 5 wherein secondary winding 10 comprises a secondary conductive film on both sides of dielectric membrane. In the embodiment of FIG. 6, instead of vias (such as vias 29 of Figure 1B), connections are made between the secondary conductive film on both sides of the dielectric membrane using wrap-around connectors 66.

Figure 7:
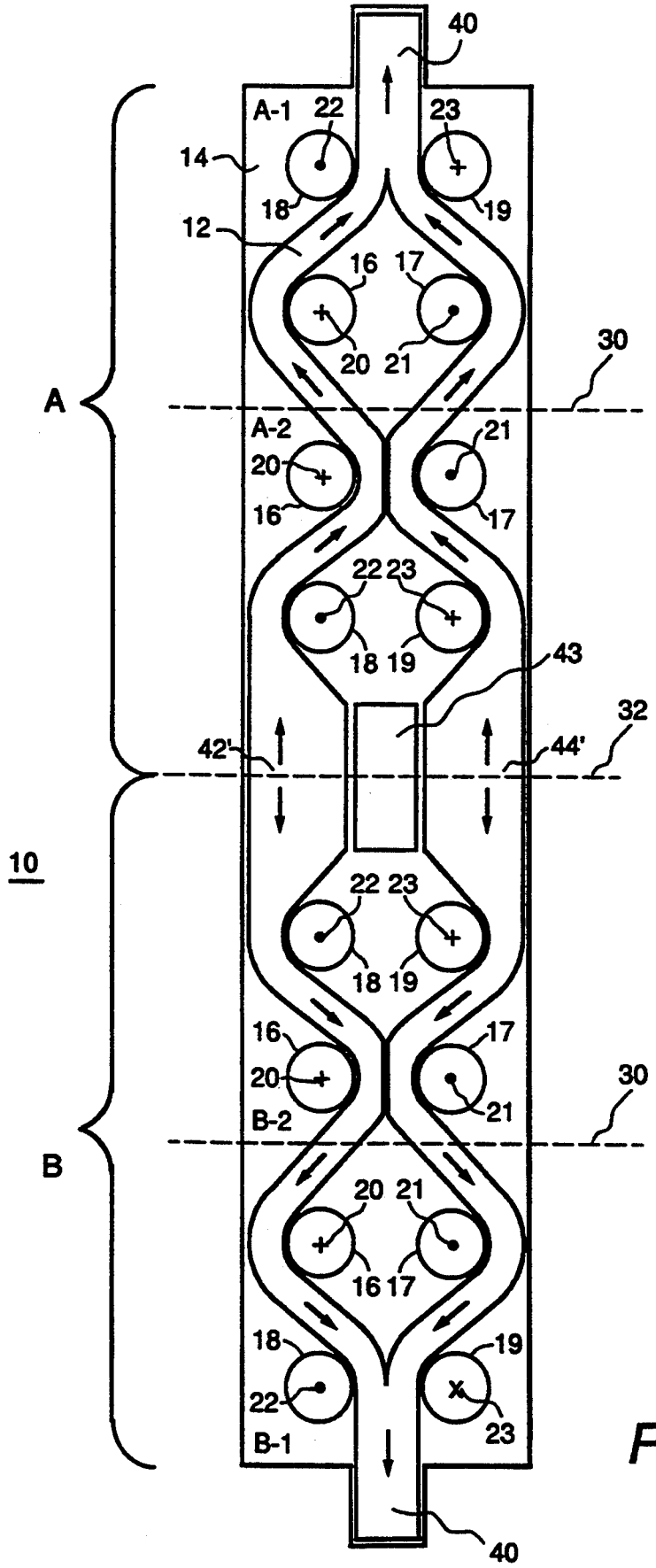
FIG. 7 is a top view illustrating an alternative embodiment of a secondary winding according to the present invention.

FIG. 7 illustrates another alternative embodiment of a secondary winding according to the present invention wherein terminals 42' and 44' are elongated such that separate metallic strips (such as strips 62 and 64 of FIG. 5) are not required to make connections among common terminals. Instead, by elongating the terminals, the metallic connecting strips are integral with the secondary conductive film. In the embodiment of FIG. 7, an opening 43 is formed between terminals 42' and 43' so as to avoid making contact with terminal 40 when folded.

Figure 8:
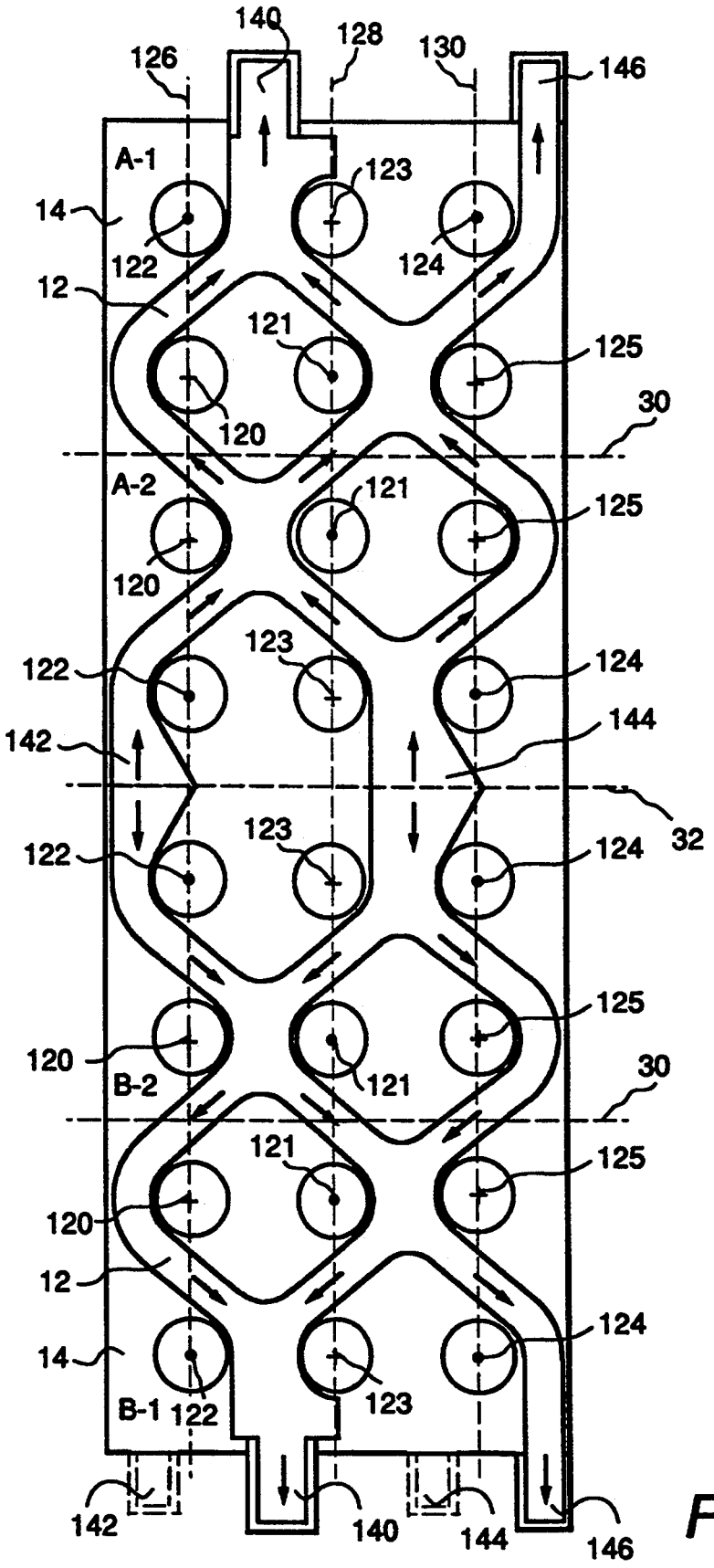
FIG. 8 is a top view illustrating another alternative embodiment of a secondary winding according to the present invention.

FIG. 8 illustrates an alternative embodiment of a secondary winding according to the present invention having six poles per section 120–125 with two adjacent poles per section along each of three longitudinal pole axes 126, 128 and 130. After z-folding, such a configuration has four terminals 140, 142, 144 and 146.

Figure 9:
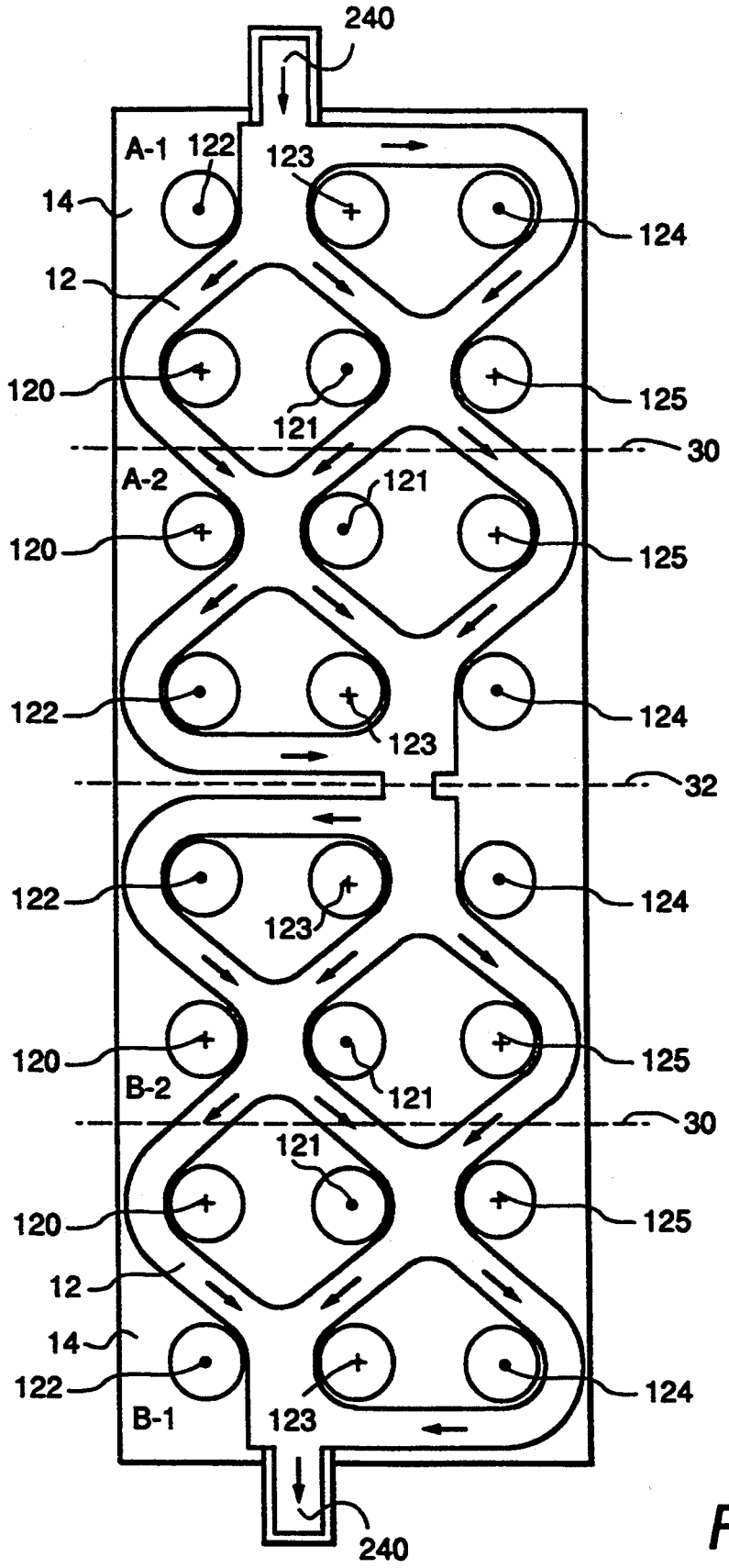
FIG. 9 is a top view illustrating another alternative embodiment of a secondary winding according to the present invention.

FIG. 9 illustrates an alternative embodiment of the secondary winding of FIG. 8 which is advantageously configured so as to require only two terminals 240 and 242 after folding.

Figure 10:
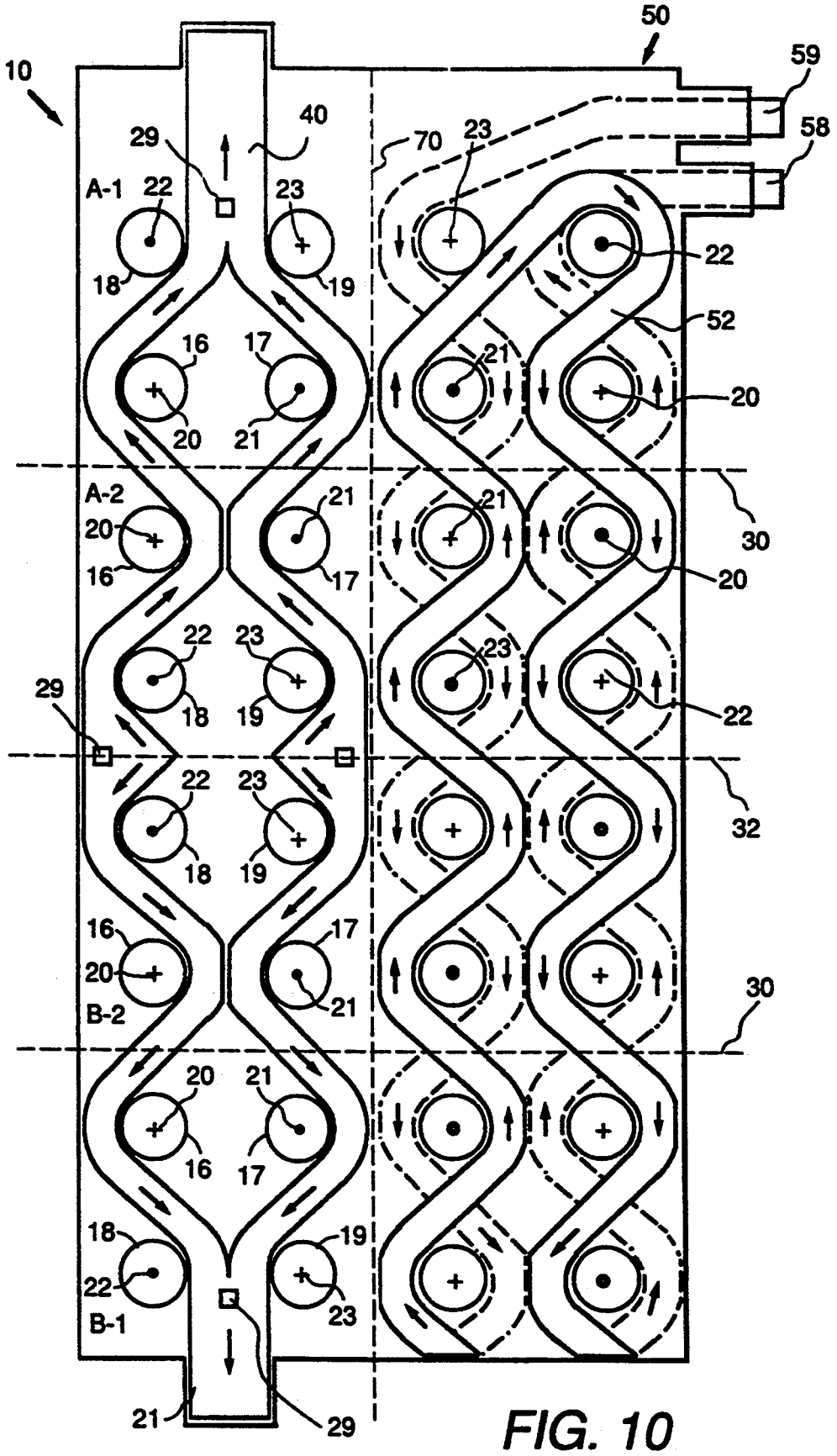
FIG. 10 illustrates an alternative embodiment of a transformer winding configuration wherein a primary and secondary winding according to the present invention are disposed side-by-side on a dielectric sheet.

FIG. 10 illustrates an alternative embodiment of a winding configuration according to the present invention wherein the primary winding and the secondary winding are situated side-by-side on the same dielectric membrane. For this configuration, a first fold is made in either direction, as desired, between the windings on fold line 70, and then the windings are z-folded along lines 30 and 32 in the same manner as described hereinabove.

Figure 11:
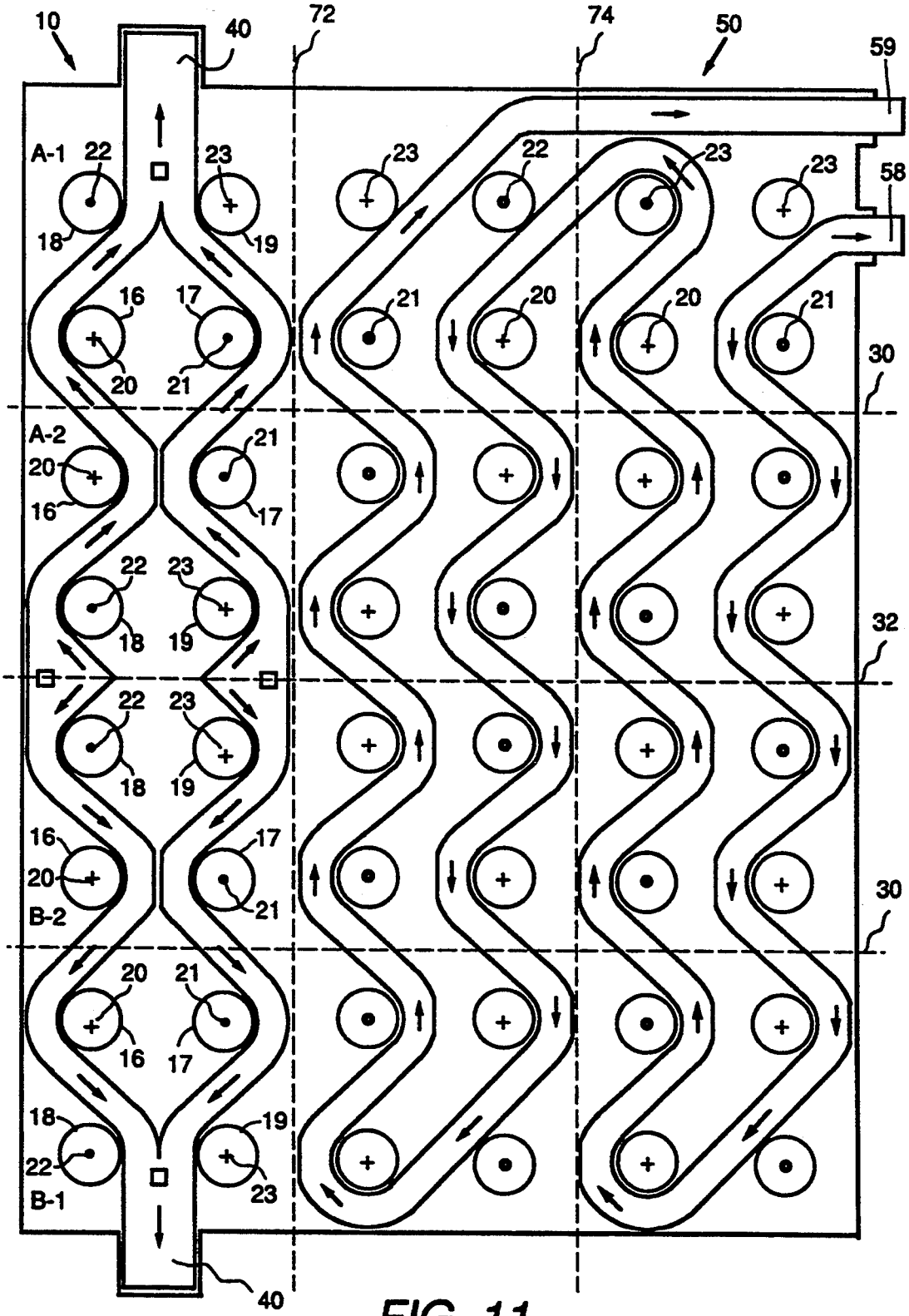
FIG. 11 is a top view of an alternative embodiment of the winding configuration of FIG. 10.

FIG. 11 illustrates an alternative embodiment of the winding configuration of FIG. 10 wherein the primary winding 50 has a primary conductive film situated on only one side of the dielectric membrane. For this configuration, the winding is initially folded along longitudinal fold lines 72 and 74, and then the windings are z-folded along lines 30 and 32 in the same manner as described hereinabove.

Figure 12:
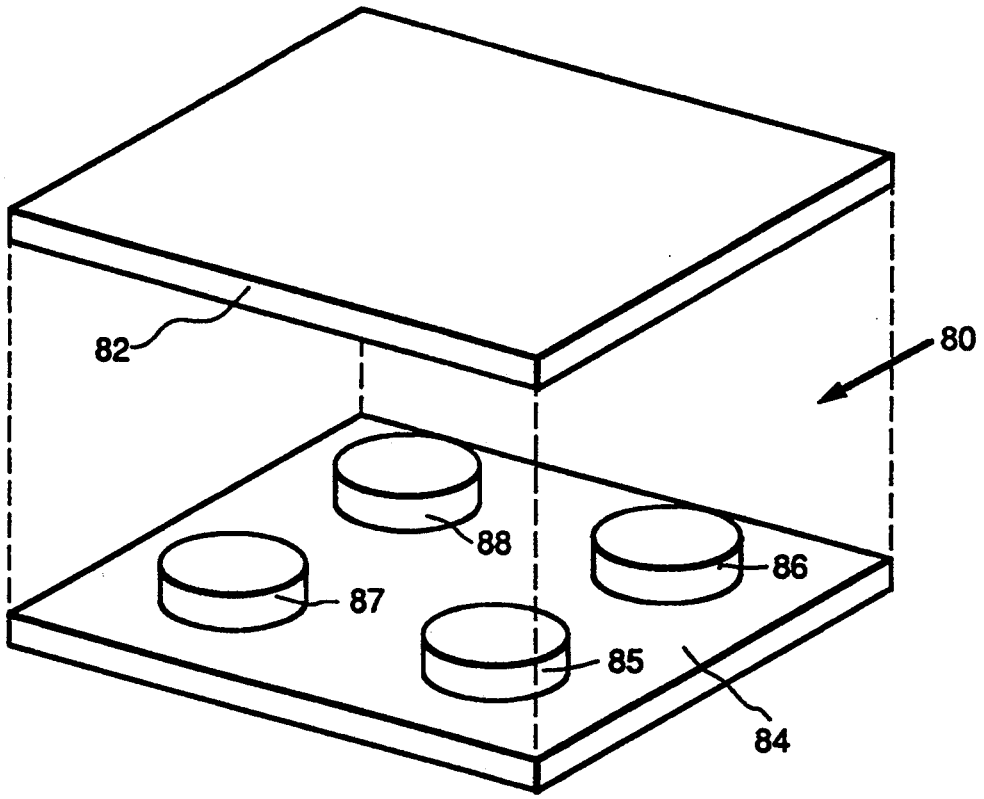
FIG. 12 is a perspective view of a magnetic core structure useful for a transformer configured according to the present invention.

Interleaved primary and secondary windings are inserted into a magnetic core, such as a core 80 of FIG. 12. Core 80 has a top plate 82, a base plate 84 and four core posts 85–88 extending therebetween. Core 80 is constructed from a high-permeability magnetic material, exemplary high-permeability materials being manganese-zinc ferrites, such as type pc50 manufactured by TDK Corporation, type K2 manufactured by Magnetics, Inc., type N47 manufactured by Siemens, or type KB5 manufactured by Krystinel Corporation. Core posts 85–88 correspond to magnetic poles 20–23 such that the corresponding apertures in the primary and secondary windings fit about the core posts upon insertion of the windings into the core.

Figure 13:
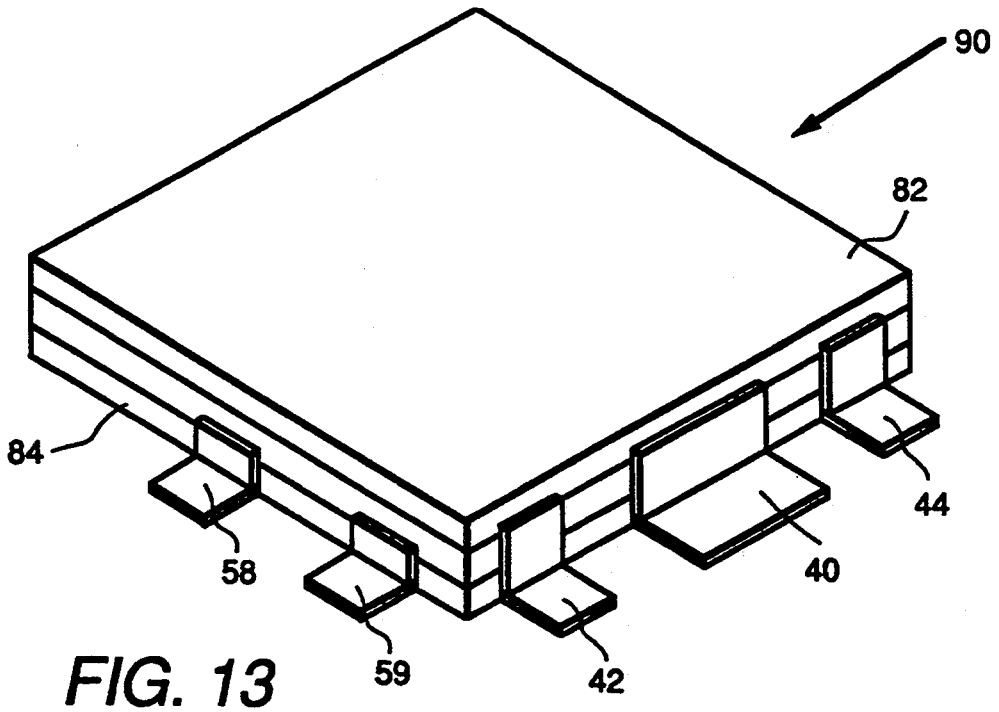
FIG. 13 is a perspective view of an assembled transformer according to the present invention.

FIG. 13 illustrates a transformer 90, with a primary winding such as that of FIG. 1 and a secondary winding such as that of FIG. 2, assembled in the magnetic core of FIG. 12. Secondary terminals 40, 42 and 44 are aligned on two opposite sides of the core, and primary winding terminals 58 and 59 are aligned on only one side of the core. The result is a low-profile conductive film transformer with a multi-turn secondary winding configuration exhibiting a low magnetic flux density in the core. Furthermore, a conductive film transformer according to the present invention has simple terminations integral with the winding structure itself, simplifying connections between winding layers and with other circuit components.

For a combination transformer/inductor, a core having an air gap is needed. To this end, the core of FIG. 12 may be used with a gap between the poles of the base plate and the top plate.

Figure 14:
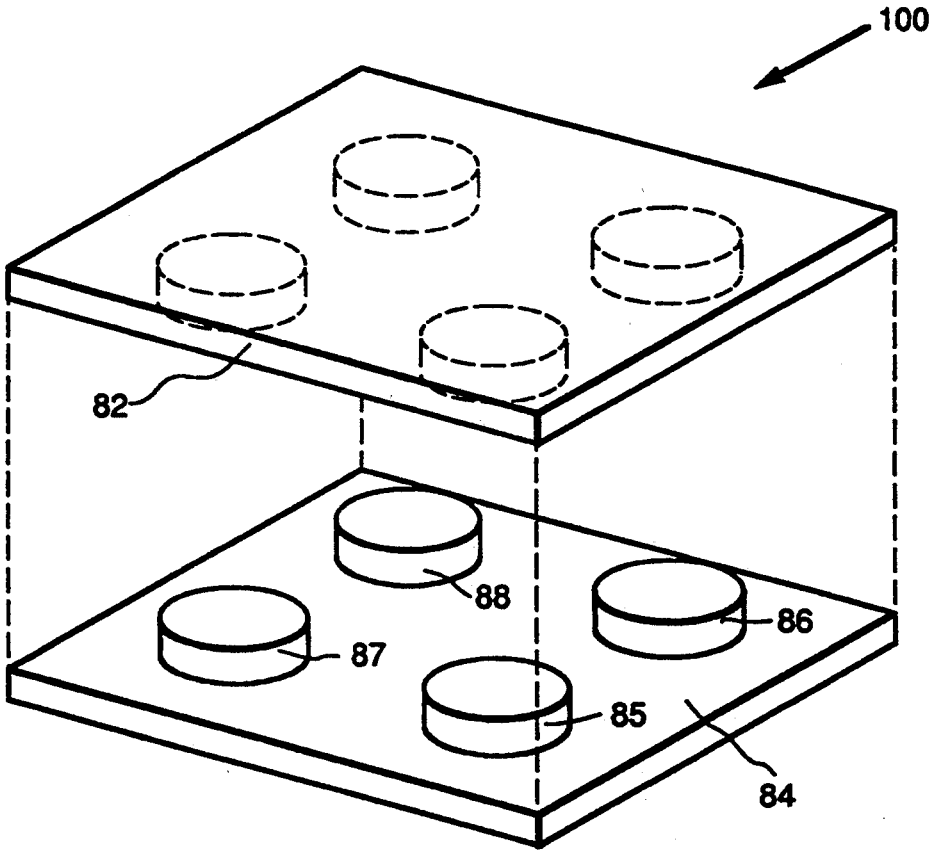
FIG. 14 is an alternative embodiment of a magnetic core structure useful for a transformer configured according to the present invention.

FIG. 14 illustrates an alternative embodiment of a transformer core 100 useful with a winding configuration according to the present invention. The core of FIG. 14 includes a top plate 82 and a bottom plate 84 each having poles. For a combination transformer/inductor, a gap between the poles of the top and bottom plates comprises an air gap.

Figure 15A:
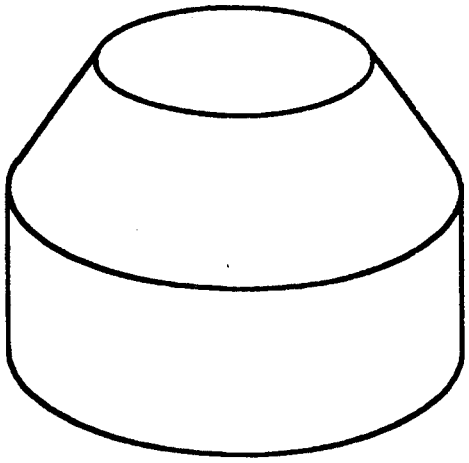
FIGS. 15A–15C are alternative embodiments of a magnetic pole structure for a magnetic core useful for a combination transformer/inductor according to the present invention.
Figure 15B:
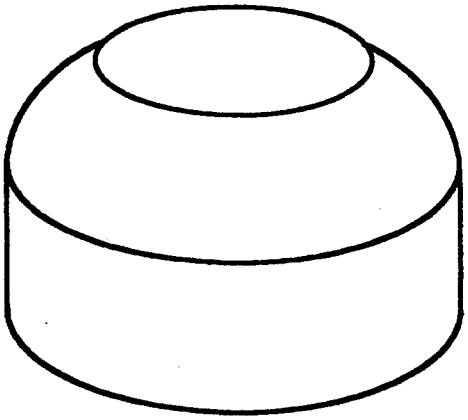
Figure 15C:
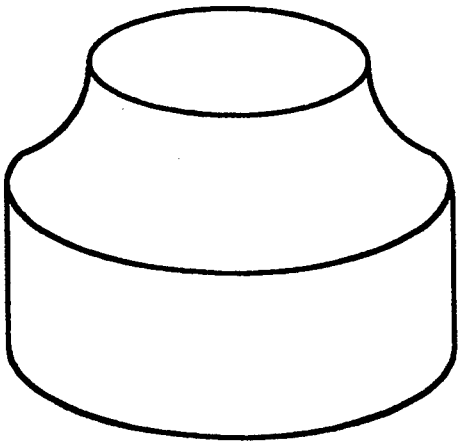

To reduce fringing fields in a combination transformer/inductor, the pole pieces of FIGS. 12 or 14 can be modified to be rounded or tapered, as shown in FIGS. 15A–15C.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A transformer, comprising:

a primary winding comprising a primary conductive film disposed on a primary dielectric membrane, said primary conductive film being z-foldable to form a multi-layer primary winding;

a secondary winding interleaved with said primary winding, said secondary winding comprising a secondary conductive film disposed on at least one surface of a secondary dielectric membrane and having two ends, said secondary conductive film having at least two portions arranged as mirror images of each other, each of said portions comprising a plurality of sections, each of said sections including an even number of apertures, each of said apertures corresponding to a separate respective magnetic pole such that there are at least two adjacent poles per section along at least one longitudinal pole axis, said conductive film being z-foldable to form a stack of winding layers with a single turn per two adjacent layers about each said magnetic pole, each of said layers comprising one of said sections, each single turn about each respective adjacent pole along said at least one longitudinal pole axis being connected in series to form a total number of secondary winding turns corresponding to the number of sections in each of said portions;

an end terminal at each end of said secondary conductive film, said end terminals being connected together; and at least one additional terminal situated where said at least two portions meet, each corresponding additional terminal being connected together, each of said portions of said winding being connected in parallel to each other.

2. The transformer of claim 1, comprising four of said apertures per each said section, one pair of said apertures being adjacent along a first longitudinal pole axis and another pair of said apertures being adjacent along a second longitudinal pole axis.

3. The transformer of claim 1, further comprising a magnetic core having core posts sized to fit within said apertures.

4. The transformer of claim 3 wherein said magnetic core has an air gap formed therein.

5. The transformer of claim 4 wherein said core posts are tapered in order to reduce fringing flux thereabout.

6. The transformer of claim 4 wherein said core posts are rounded in order to reduce fringing flux thereabout.

7. The transformer of claim 1 wherein said primary conductive film and said secondary conductive film each comprise copper.

8. The transformer of claim 1 wherein said primary dielectric membrane and said secondary dielectric membrane each comprise a polyimide film.

9. The transformer of claim 1, comprising a secondary conductive film disposed on both surfaces of said secondary dielectric membrane, said secondary conductive films being connected together in parallel.

10. The transformer of claim 1, further comprising separate metallic strips for connecting corresponding terminals of said secondary winding together.

11. The transformer of claim 1, further comprising metallic strips integral with each said additional terminal for connecting each corresponding additional terminal together.

12. The transformer of claim 1, comprising six of said apertures per each said section, a first pair of said apertures being adjacent along a first longitudinal axis, a second pair of said apertures being adjacent along a second longitudinal axis, and a third pair of said apertures being adjacent along a third longitudinal axis, said transformer comprising an additional end terminal at each end of said secondary conductive film, said additional end terminals being connected together.

13. The transformer of claim 1 where said primary dielectric membrane and said secondary dielectric membrane are integral with each other such that said primary winding and said secondary winding are disposed side-by-side on a single dielectric membrane.

14. The transformer of claim 13 wherein said primary conductive film and said secondary conductive film are disposed on the same surface of said single dielectric membrane.

15. The transformer of claim 13 wherein said primary conductive film and said secondary conductive film are each disposed on both surfaces of said single dielectric membrane.

16. The transformer of claim 3 wherein said magnetic core comprises two magnetic plates, said core posts being situated on one of said two magnetic plates.

17. The transformer of claim 3 wherein said magnetic core comprises two magnetic plates, corresponding ones of said core posts being situated opposite each other on each of said magnetic plates.

* * * * *